US010334920B1

(12) United States Patent
Chagalamarri

(10) Patent No.: US 10,334,920 B1
(45) Date of Patent: Jul. 2, 2019

(54) UMBRELLA HOLDER AND STABILIZATION SYSTEM

(71) Applicant: Vishnu Vardhan Chagalamarri, Ellicott City, MD (US)

(72) Inventor: Vishnu Vardhan Chagalamarri, Ellicott City, MD (US)

( * ) Notice: Subject to any disclaimer, the term of this patent is extended or adjusted under 35 U.S.C. 154(b) by 0 days.

(21) Appl. No.: 16/154,221

(22) Filed: Oct. 8, 2018

Related U.S. Application Data

(60) Provisional application No. 62/708,398, filed on Dec. 8, 2017.

(51) Int. Cl.
*A45B 11/02* (2006.01)
*A45F 3/00* (2006.01)

(52) U.S. Cl.
CPC ..... *A45B 11/02* (2013.01); *A45F 3/005* (2013.01); *A45F 2003/002* (2013.01)

(58) Field of Classification Search
CPC ..... A45B 11/02; A45F 2003/025; A45F 3/14; A45F 3/005; A45F 2003/002
USPC ..... 224/188–190
See application file for complete search history.

(56) References Cited

U.S. PATENT DOCUMENTS 1,466,715 A * 9/1923 Hart ..... A45B 11/02 224/188
1,657,263 A * 1/1928 Lauby ..... A45B 11/02 224/188
3,700,149 A * 10/1972 Grogan ..... A45B 11/02 224/188
4,537,339 A * 8/1985 Pearson ..... A45B 11/02 224/186
4,967,943 A 11/1990 Massey
5,263,837 A 11/1993 Dompe
5,353,977 A * 10/1994 Schiro, Jr. ..... A45B 11/02 135/16
5,513,786 A 5/1996 Drane
5,620,119 A 4/1997 Keller
5,878,761 A 3/1999 Vadher
5,887,771 A 3/1999 Perry
5,918,612 A 7/1999 Hughes
6,024,464 A 2/2000 De Vera
6,357,710 B1 3/2002 Fielden et al.
6,619,520 B2 9/2003 Hammond
6,619,521 B2 9/2003 Hadley
6,926,018 B1 8/2005 Ryo
7,275,668 B1 * 10/2007 Carroll ..... A45B 11/02 135/16

(Continued)

*Primary Examiner* — Corey N Skurdal
(74) *Attorney, Agent, or Firm* — Dale J. Ream

(57) ABSTRACT

An umbrella holder and stabilization system for hands-free holding of an umbrella includes a housing having a plurality of walls that, collectively, define an interior space, and a top wall defining an opening for receiving the handle of the umbrella into the interior space. The system includes a neck strap having opposed ends and a fastener coupling the ends so to form a loop. At least one clamp is coupled to the neck strap that is slidable along an extent of the neck strap and is operable to releasably capture the pole of the umbrella. A belt includes a strap having opposed ends that is selectively attachable about one of a user's chest or a user's waist. A connector strap may extend between the torso belt and neck strap. Thus, an umbrella is secured in the housing and held upright without use of a user's hands.

20 Claims, 8 Drawing Sheets

(56) References Cited

U.S. PATENT DOCUMENTS

| | | | | |
|---|---|---|---|---|
| 8,132,582 | B2 * | 3/2012 | Goebel | A45B 11/02 135/16 |
| 8,556,141 | B1 * | 10/2013 | Ferraiolo | A45B 17/00 224/186 |
| 2008/0116236 | A1 * | 5/2008 | Nickels | A45B 11/02 224/190 |
| 2010/0243689 | A1 * | 9/2010 | Fozooni | A45B 11/02 224/190 |
| 2011/0062197 | A1 * | 3/2011 | Cottrell | A45B 11/02 224/188 |
| 2012/0273533 | A1 * | 11/2012 | Boden | A45B 11/02 224/190 |
| 2013/0313295 | A1 * | 11/2013 | Jacquette | A45B 11/02 224/190 |

* cited by examiner

UMBRELLA HOLDER AND STABILIZATION SYSTEM

REFERENCE TO RELATED APPLICATIONS

This application claims the benefit of provisional patent application U.S. Ser. No. 62/708,398 filed Dec. 8, 2017 titled "Umbrella Harness Pouch" and which is incorporated in its entirety herein by reference.

BACKGROUND OF THE INVENTION

This invention relates generally to holders of umbrellas and, more particularly, to an umbrella holder and stabilization and stabilization system that is worn around a user's neck, that receives a handle of an umbrella into a pouch, and includes clamps and straps for stabilizing the umbrella for hands-free use.

If a driver of an automobile gets a flat tire while driving in the rain and chooses to change the flat tire, he most assuredly will himself get wet in that the driver will be unable to hold an umbrella over his head while manipulating the flat and spare tires, unfasten and fasten the lug nuts on the wheel, and the like. Similarly, carrying groceries from a car to a house in the rain will require more trips while holding an umbrella or just getting wet by abandoning the umbrella altogether.

Various devices have been proposed in the art for holding an umbrella hands-free so that a person can either change a tire in the rain or perform other tasks without holding the umbrella. Although presumably effective for their intended purposes, there is still a need for an umbrella holder having a housing, such as a pouch, configured to receive a handle of a traditional umbrella and support the umbrella in an upright and stable configuration free of any involvement by a user.

Therefore, it would be desirable to have an umbrella holder and stabilization system for securing an umbrella in an upright configuration without use of a user's hands that overcomes the disadvantages of the prior art.

SUMMARY OF THE INVENTION

An umbrella holder and stabilization system according to the present invention for hands-free holding of an umbrella of a type having a pole, a canopy, and a crook handle, the umbrella holder and stabilization system includes a housing having a bottom wall and a plurality of side walls extending upwardly from the bottom wall that, collectively, define an interior space, the housing having a top wall spanning between upper edges of the plurality of side walls and defining an opening operable to receive the crook handle of the umbrella into the interior space. The system includes a neck strap member operably coupled to the housing and having a first end and a second end opposite the first end and a neck strap fastener coupling the first end to the second end so that the neck strap member is a loop. At least one clamp is slidably coupled to the neck strap member that is slidable along an extent of the neck strap member and is operable to releasably capture the pole of the umbrella. A belt member includes a strap having opposed ends that is selectively attachable about one of a user's chest or a user's waist. A connector strap may extend between the belt member and neck strap member.

Therefore, a general object of this invention is to provide an umbrella holder and stabilization system for securing an umbrella in an upright configuration without use of a user's hands.

Another object of this invention is to provide an umbrella holder and stabilization system, as aforesaid, so that a user may use his hands for other tasks, such as changing a tire or carrying grocery bags, while still being shielded from weather elements such as rain.

Still another object of this invention is to provide an umbrella holder and stabilization system, as aforesaid, in which an umbrella handle is received into a housing pouch and stabilized by clamps and a strap system around a user's neck.

Yet another object of this invention is to provide an umbrella holder and stabilization system, as aforesaid, that is cost effective to manufacture and affordable to purchase.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
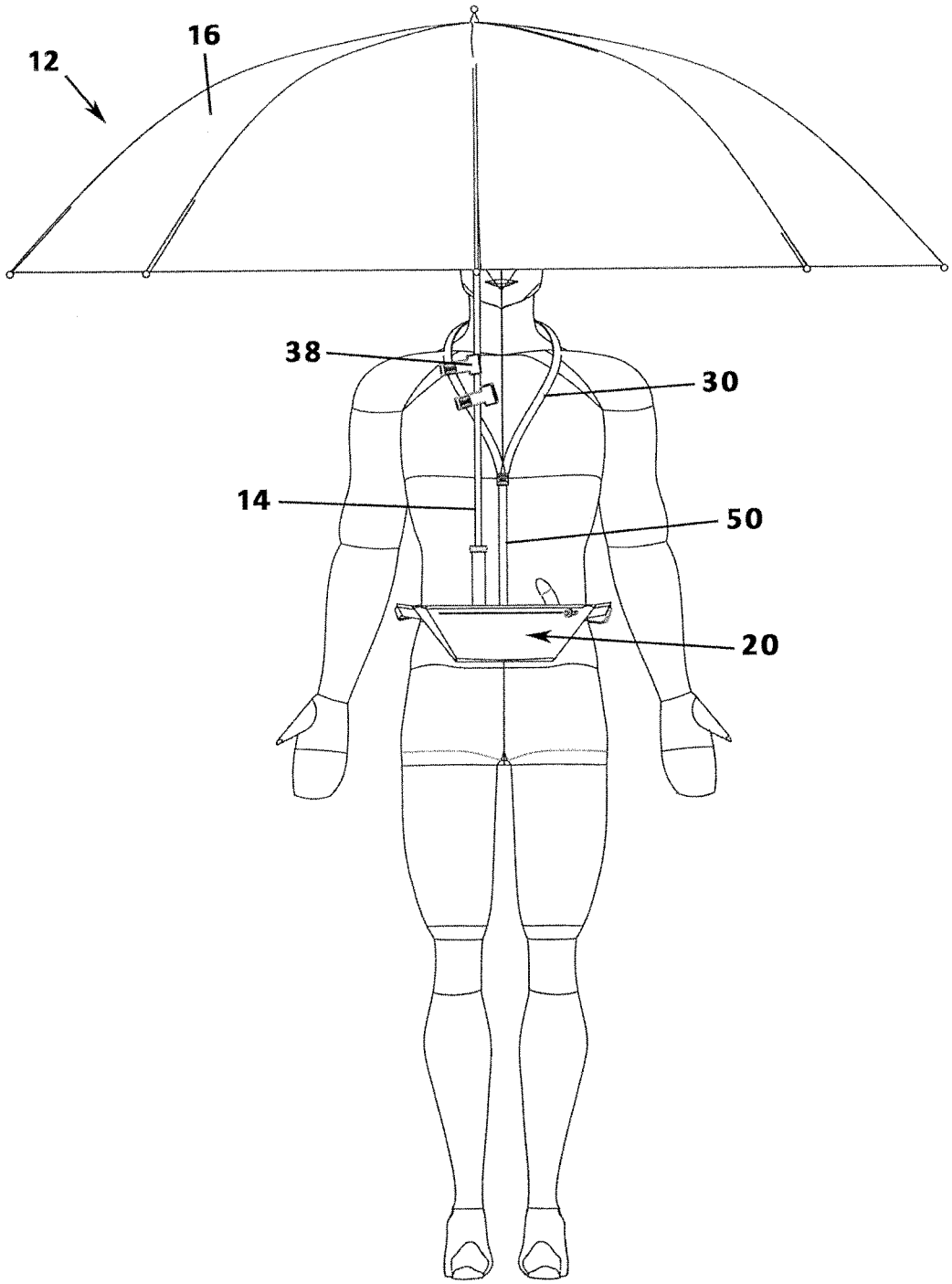
FIG. 1 is a front perspective view of an umbrella holder and stabilization system according to a preferred embodiment of the present invention, illustrated in use with an umbrella and worn by a mannequin.

An umbrella holder and stabilization system according to a preferred embodiment of the present invention will now be described in detail with reference to FIGS. 1 to 9 of the accompanying drawings. The umbrella holder and stabilization system 10 includes a neck strap member 30, a belt member 40, a connector strap member 50, and a housing 20. The umbrella holder and stabilization system 10 enables an umbrella 12 to be held upright to shield a user from a rain event without using his hands, the umbrella 12 being of a type having a crook handle 18, a pole 14, and a canopy 16.

In an embodiment, the housing 20 may be a pouch or what is termed a "fanny pack." The housing 20 may be constructed of flexible material such as nylon, plastic, or combinations thereof. Preferably, the housing 20 include a bottom wall 21 that is durable and not easily punctured along with a plurality of side walls 22 extending upwardly from peripheral edges of the bottom wall 21. The housing 20 may also include a top wall 23 extending between a continuous upper edge of the plurality of side walls 22. It is understood that the bottom wall 21, top wall 23, and plurality of side walls 22 may have a unitary construction although individual panels may be utilized and connected together by sewing, such as with stitching. In the preferred embodiment, the top wall 23 defines an opening 26, which may be referred to as a slot, channel, slit, or the like. In use, the crook end of a handle 18 of an umbrella can be inserted through the opening 26 when open. In addition, at least one of a side wall 22 or the top wall may include a zippered pouch 25 internally having an interior space for holding articles such as keys, a wallet, a watch, or the like. The zippered pouch 25 may include a zipper or other fastener for allowing or not allowing access into the interior space of the pouch.

The housing 20 may include at least one but preferably a pair of housing fasteners for attachment of the connector strap member 50 and or other components as will be described later. In an embodiment, the housing fasteners may include a tab and ring combination. In another embodiment, the straps and belt described herein may be attached to the housing with stitching, a tab 56, or other suitable fasteners.

The umbrella holder and stabilization system 10 may be worn about the neck of a user. To enable this wearing of the invention, the neck strap member 30 is a strap arranged as a loop that is length adjustable and capable of looping around the neck of users of different sizes or ages. More particularly, the neck strap member 30 has a first end 32 and a second end 34 opposite the first end 32, the opposed ends being attached together with a neck strap fastener 36 that is slidably movable so as to adjust the diameter of the loop. The neck strap fastener 36 may be a slidable strap adjuster or, alternatively, a ring fastener made of plastic or metal, a latch, snap, button, buckle, D-ring, stitching, or the like. The strap itself may be constructed of a flexible material such as nylon, leather, plastic, cloth, or other fabric.

Preferably, the neck strap member 30 is attached or connected to the housing 20—either directly or via other components that may be coupled intermediate the housing 20 and neck strap member 30 as described below. For instance, the connector strap member 50 and belt member 40 may be situated intermediate the housing 20 and neck strap member 30 as will be described later.

Figure 2:
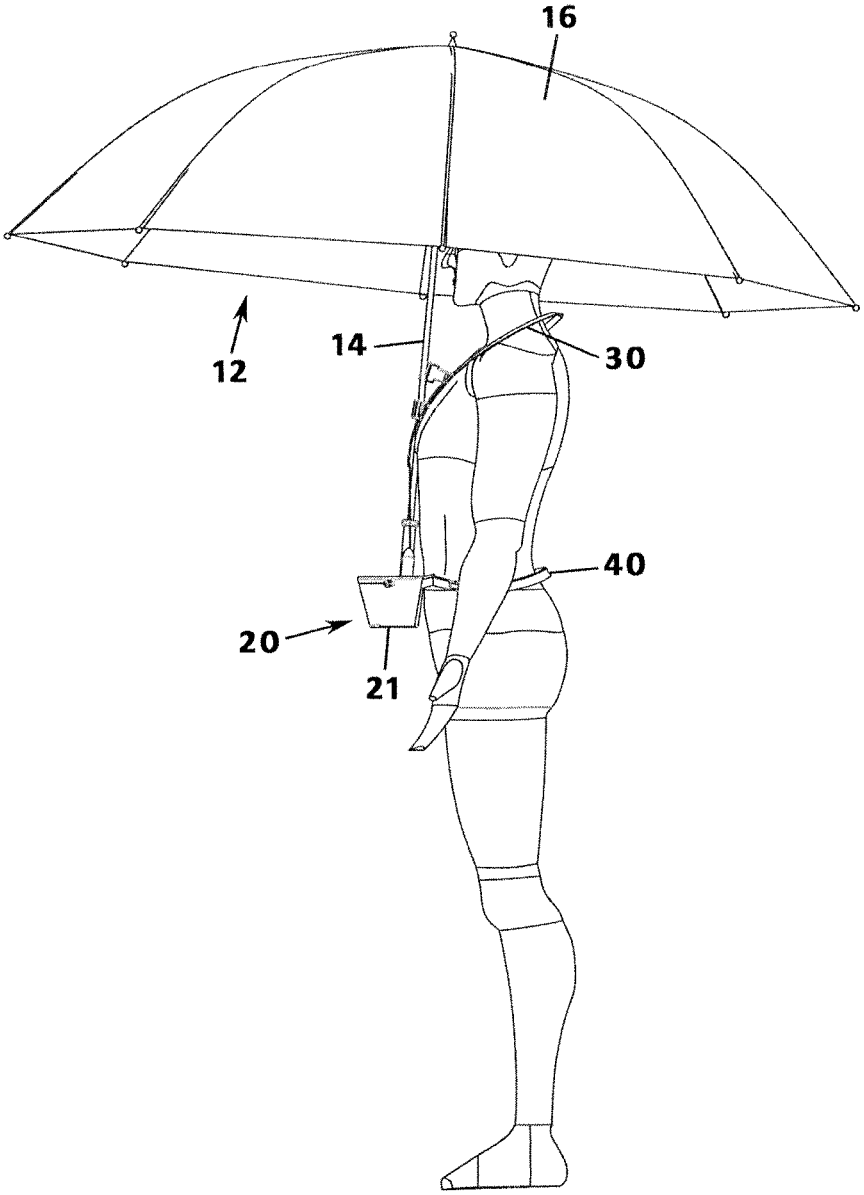
FIG. 2 is a side view of the system as in FIG. 1.
Figure 3:
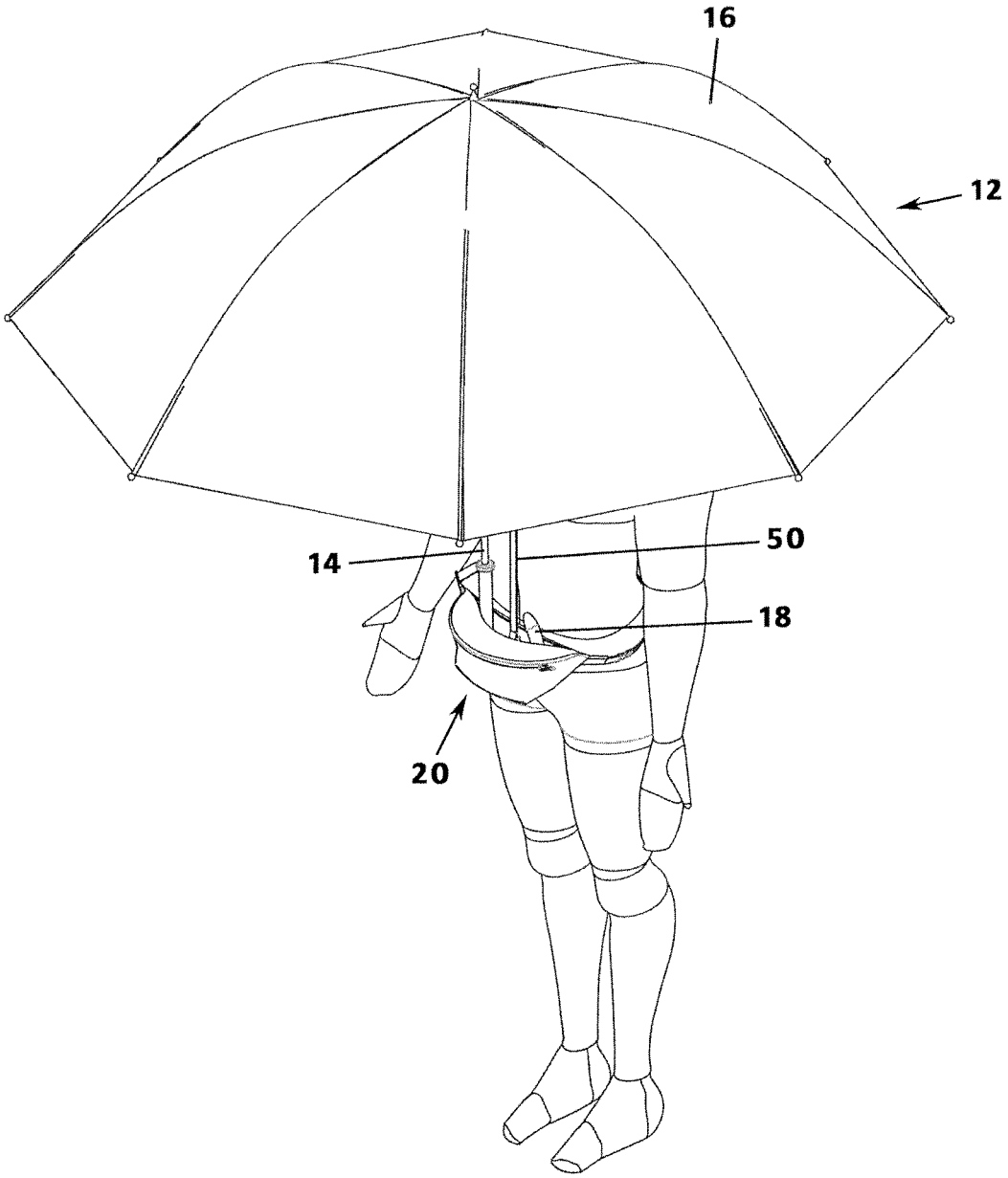
FIG. 3 is an elevated perspective view of the system as in FIG. 1.
Figure 4:
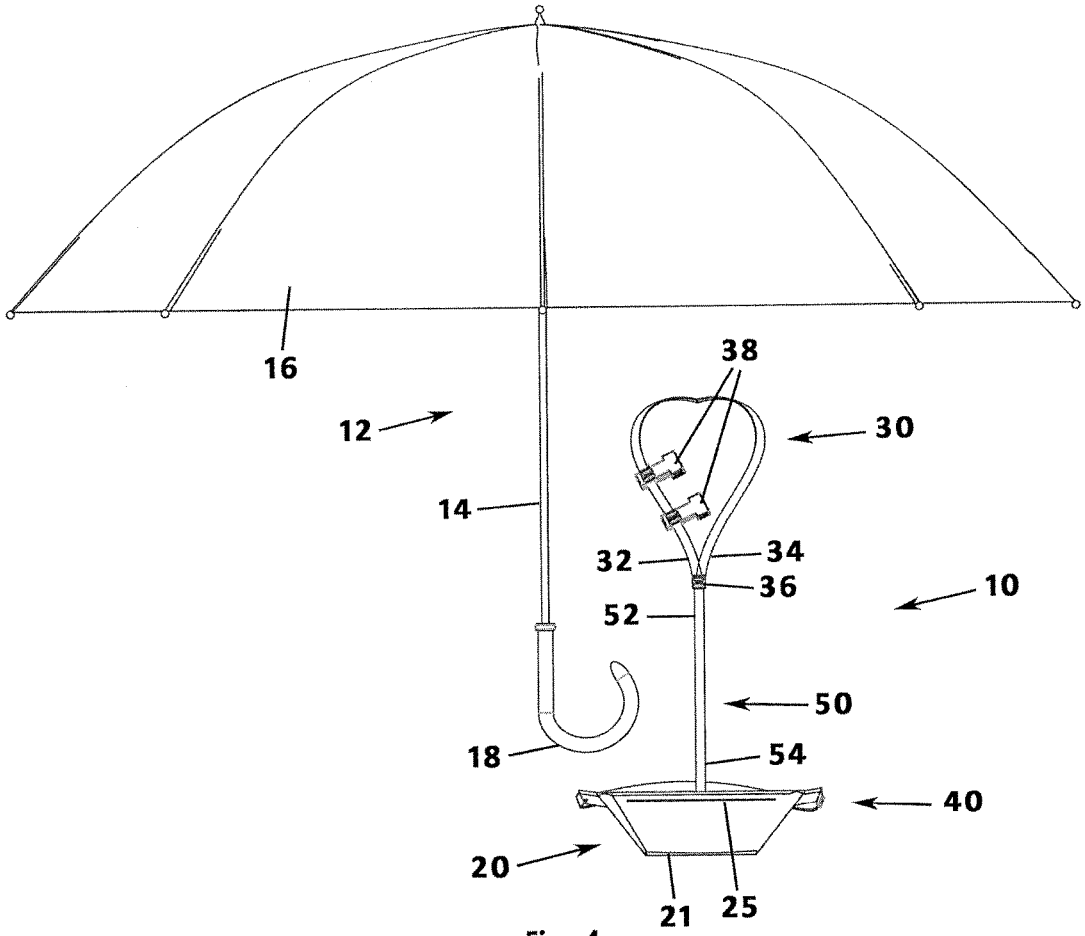
FIG. 4 is a front view of the system as in FIG. 1 with the mannequin removed for clarity.
Figure 5:
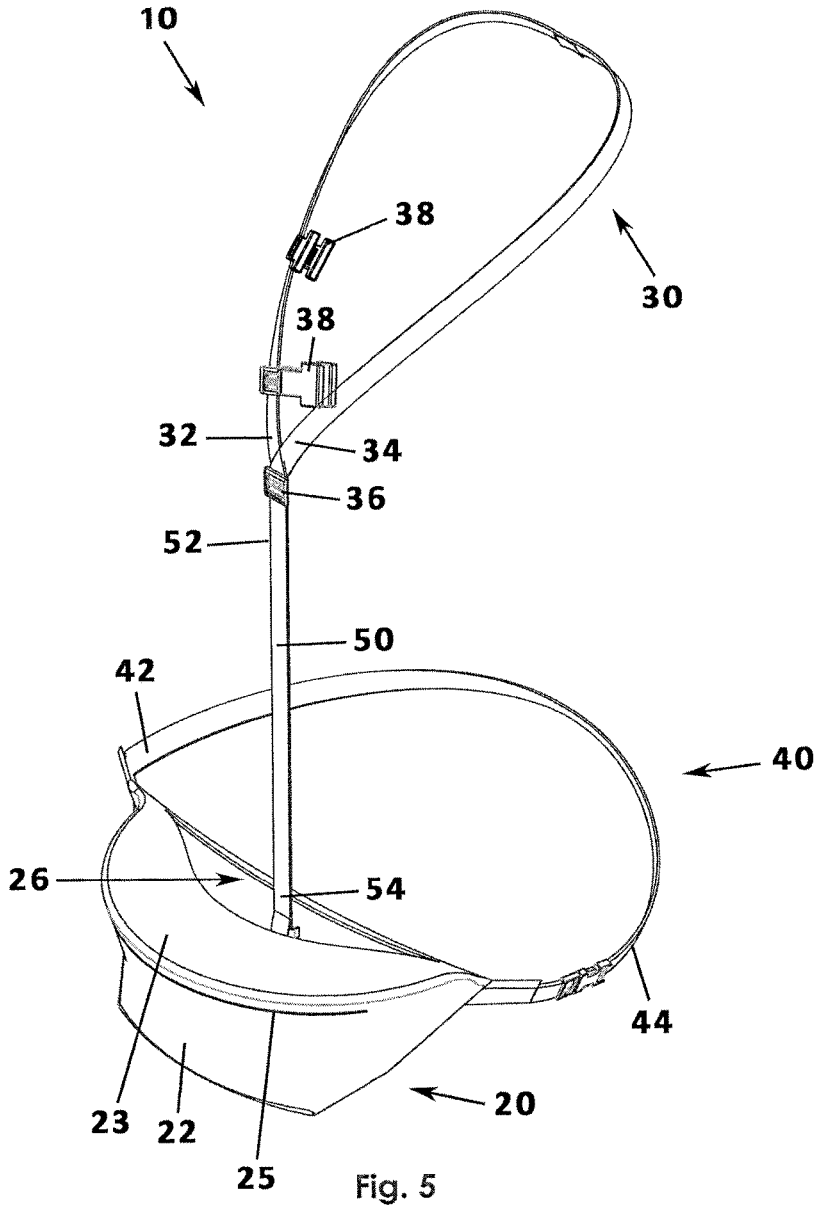
FIG. 5 is a perspective view of the umbrella holder and stabilization system according to the present invention, illustrated with the umbrella and mannequin removed.
Figure 6:
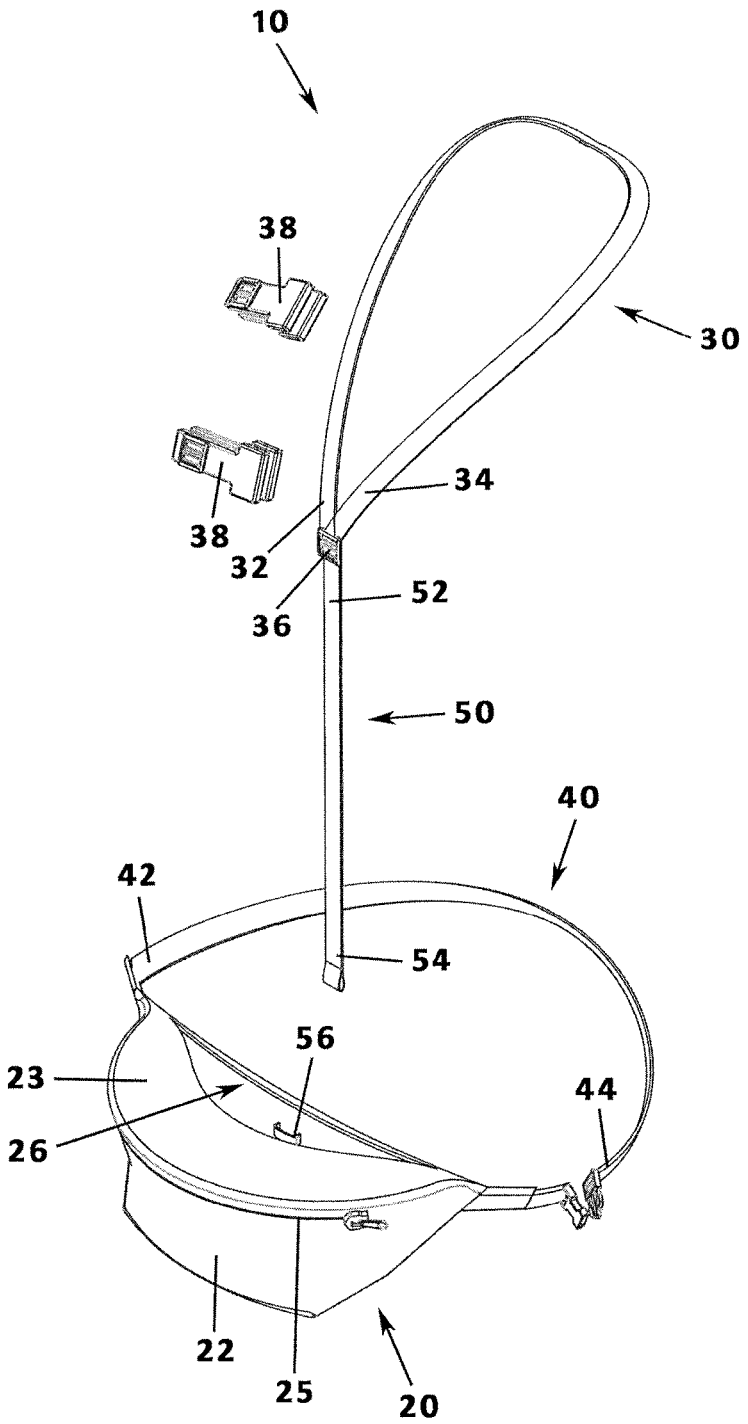
FIG. 6 is an exploded view of the system as in FIG. 5.
Figure 7:
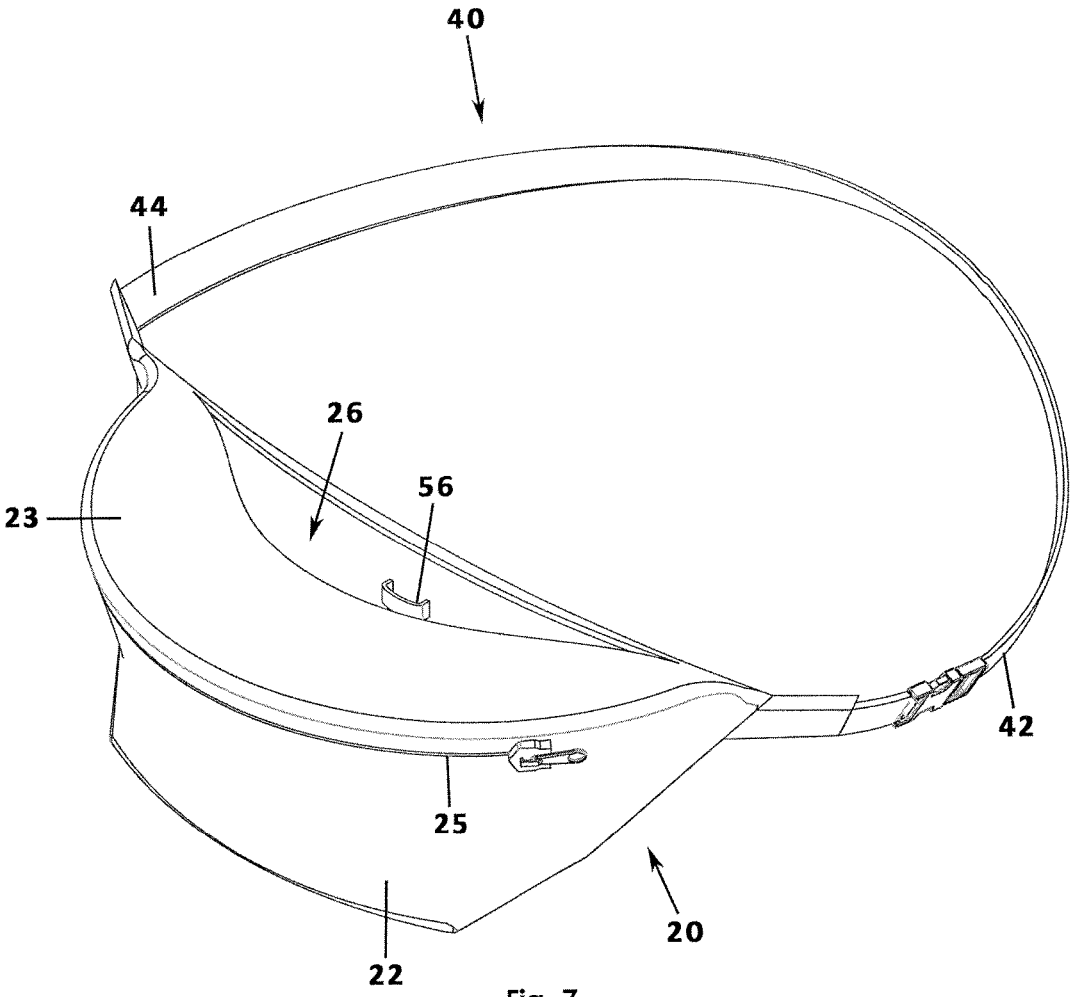
FIG. 7 is a perspective view of the housing and belt removed from the rest of the invention.
Figure 8:
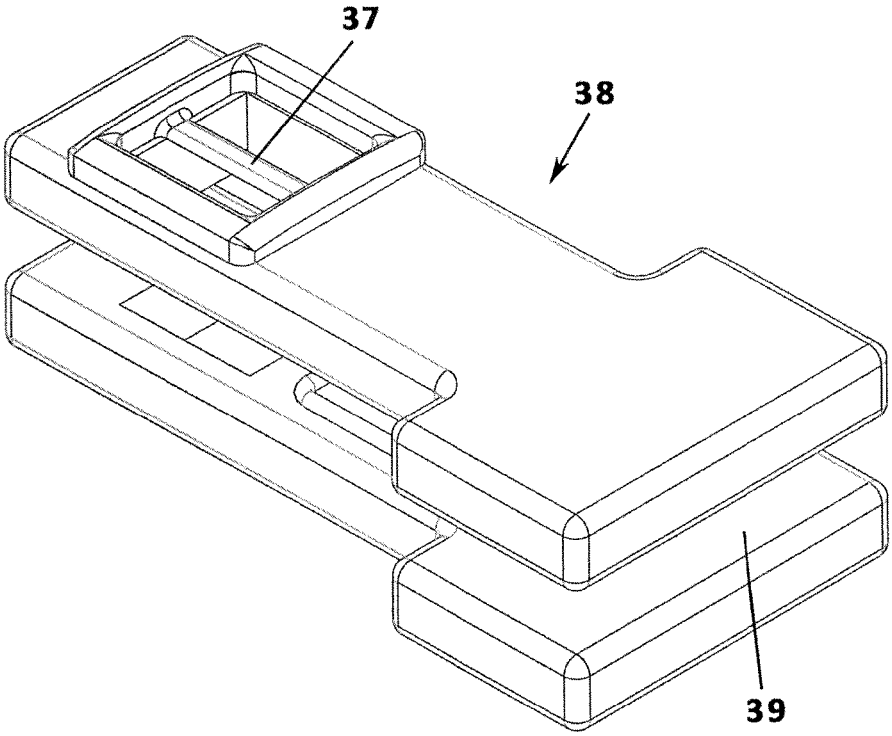
FIG. 8 is an isolated perspective view of a clamp according to the present invention.
Figure 9:
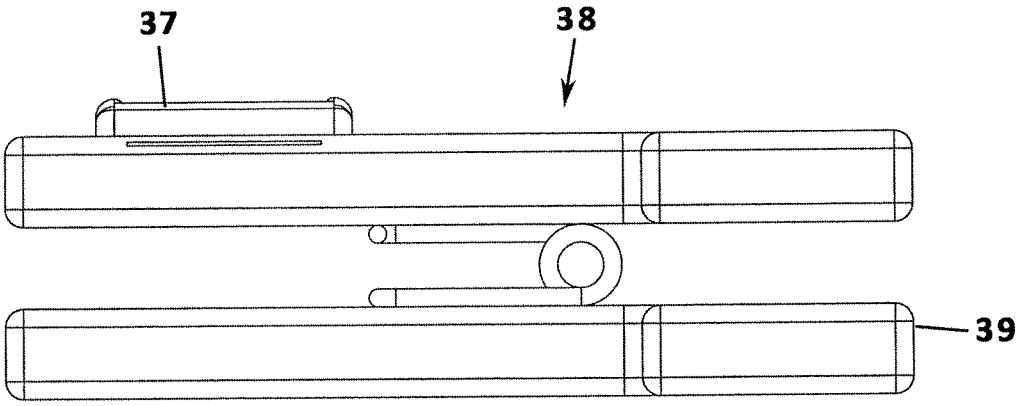
FIG. 9 is a side view of the clamp as in FIG. 8.

The umbrella holder and stabilization system 10 includes the belt member 40 that is configured and operable to be positioned and coupled around either the waist or chest of a person. Preferably, the neck strap member 30 and the connector strap member 50 (described later) have a length that causes the belt member 40 to be comfortably positioned and buckled about a user's waist as shown in FIGS. 1 to 3 although it may extend around a user's chest in some embodiments or due to the size of the user. The belt member 40 may include a first end 42 opposite a second end 44, each end having a fastener, such as a buckle, a quick-connect fastener, or traditional seat belt style latch. The belt member 40 may be a nylon strap that is flexible although other materials may also work, such as leather, plastic, cloth, or the like. Preferably, the belt member 40 has a construction that is length adjustable so as to be worn by users of different ages and sizes.

The belt member 40 may be coupled to the neck strap member 30 and to the housing 20 although it is understood that there may be other strap components therebetween, such as the connector strap member 50 to be described later. More particularly, the belt member 40 may be coupled to the housing fasteners using a quick-connect fastener, a buckle, or a carabiner (not shown), the carabiner being coupled to a ring fastener and stitched fabric tab of the housing 20.

Preferably, the housing 20 is positioned at or just below the waist of a user for optimal holding of an umbrella 12. To properly position the housing 20, the umbrella holder and stabilization system 10 may include the connector strap member 50 which extends downwardly and longitudinally between the neck strap member 30 and the belt member 40 or all the way to the housing 20. Preferably, the neck strap member 30 and the connector strap member 50 have a unitary construction (i.e. a single strap system) although the specific portions of the connector strap member 50 will be identified by reference numerals for clarity. For instance, the connector strap member 50 may include an upper end 52 coupled to a suitable portion of the neck strap member 30. Similarly, the connector strap member 50 includes a lower end 54 coupled to the housing 20 as shown in the drawings, such as by stitching, a tab 56, or other suitable fastener. The connector strap member 50 enables the neck strap member 30 to be operably coupled to both the belt member 40 and to the housing 20.

In a critical aspect, the umbrella 12 is secured in an upright configuration without the use of a user's hands by the at least one and, preferably, a pair or plurality of clamps 38. More particularly, each clamp 38 includes a strap attachment portion that is slidably coupled to either the neck strap member 30 or to the connector strap member 50 or both. In fact, the at least one clamp 38 and preferably a pair of clamps is slidable along an extent of the neck strap member 30 as desired or is slidable along an extent of the connector strap member 50. In other words, a user has a strap slider portion 37 which enables the clamp 38 to move around slidably depending on the user's body size, the size of the umbrella, or based on preference. Each clamp 38 also includes a receiver portion 39 configured like a pair of jaws operable for frictionally receiving the pole 14 of an umbrella 12.

With the crook handle 18 of the umbrella 12 inserted into the housing 20 and resting on the bottom wall 21 thereof and with the pole 14 of the umbrella 12 secured by respective clamps 38, the umbrella is stabilized to shield a user from rain showers while leaving the user's hands free to perform other tasks, such as changing a tire (FIGS. 1 and 2).

It is understood that while certain forms of this invention have been illustrated and described, it is not limited thereto except insofar as such limitations are included in the following claims and allowable functional equivalents thereof.

The invention claimed is:

1. An umbrella holder and stabilization system for hands-free holding of an umbrella of a type having a pole, a canopy, shaft, and a crook handle, said umbrella holder and stabilization system, comprising:

a housing having a bottom wall and a plurality of side walls extending upwardly from said bottom wall that, collectively, define an interior space, said housing having a top wall spanning between upper edges of said plurality of side walls and defining an opening operable for receiving the crook handle of the umbrella into the interior space;

a neck strap member having a first end and a second end opposite said first end and a neck strap fastener coupling said first end to said second end so that said neck strap member is a loop;

at least one clamp slidably coupled to said neck strap member having a configuration that is slidable along an extent of said neck strap member and is operable to releasably capture the pole of the umbrella;

wherein said housing includes a fastener operably coupled to said neck strap for coupling said housing to said neck strap member.

2. The holder and stabilization system as in claim 1, wherein said housing is a pouch and said bottom wall and said plurality of side walls of said housing are constructed of a flexible material.

3. The holder and stabilization system as in claim 1, wherein said at least one clamp is a pair of clamps, each clamp of said pair of clamps having an attachment portion that is independently and slidably movable along said extent of said neck strap member and a receiver portion operable to receive the pole of the umbrella.

4. The holder and stabilization system as in claim 1, wherein said neck strap member is length adjustable so as to fit users of different body sizes.

5. The holder and stabilization system as in claim 1, further comprising a belt member having opposed ends, each end having a fastener such that said belt member is selectively coupled about one of a user's chest or a user's waist;

wherein said belt member is operably coupled to said housing.

6. The holder and stabilization system as in claim 5, wherein said belt member is length adjustable and is releasably coupled to said housing with fasteners.

7. The holder and stabilization system as in claim 5, further comprising a connector strap member spanning between said neck strap member and said housing.

8. The holder and stabilization system as in claim 7, wherein said connector strap member includes an upper end coupled to said neck strap member and a lower end coupled to said housing.

9. The holder and stabilization system as in claim 1, further comprising:

a connector strap member spanning between said neck strap and said housing;

said connector strap and said neck strap member have a unitary construction.

10. The holder and stabilization system as in claim 1, wherein said housing includes a zippered pouch extending along a side wall of said housing and defining an interior space, said zippered pouch being movable between open and closed configurations for selectively allowing or preventing access to said interior space, respectively.

11. An umbrella holder and stabilization system for hands-free holding of an umbrella of a type having a pole, a canopy, and a crook handle, said umbrella holder and stabilization system, comprising:

a housing having a bottom wall and a plurality of side walls extending upwardly from said bottom wall that, collectively, define an interior space, said housing having a top wall spanning between upper edges of said plurality of side walls and defining an opening operable to receive the crook handle of the umbrella into the interior space;

a neck strap member having a first end and a second end opposite said first end and a neck strap fastener coupling said first end to said second end so that said neck strap member is a length adjustable loop having an adjustable diameter;

wherein said housing is operably coupled to said neck strap member by a fastener for coupling said housing to said neck strap member; and at least one clamp slidably coupled to said neck strap member that is slidable along an extent of said neck strap member and is operable to releasably capture the pole of the umbrella; and a belt member having opposed ends coupled to opposed walls of said housing, respectively, said belt member being operable for attachment about one of a user's chest or a user's waist;

wherein said belt member is operably coupled to said housing.

12. The holder and stabilization system as in claim 11, wherein said belt member is length adjustable and is releasably coupled to said housing with fasteners.

13. The holder and stabilization system as in claim 12, further comprising a connector strap member spanning between said neck strap member and said housing.

14. The holder and stabilization system as in claim 13, wherein said connector strap member includes an upper end coupled to said neck strap fastener and a lower end coupled to said housing.

15. The holder and stabilization system as in claim 13, further comprising at least one clamp having a strap slider portion coupled to said connector strap member that is slidable along an extent of said connector strap member and includes a receiver portion operable to releasably capture the pole of the umbrella.

16. The holder and stabilization system as in claim 13, wherein said connector strap member includes an upper end coupled to said neck strap fastener via a ring fastener and a lower end coupled to said belt member via stitching.

17. The holder and stabilization system as in claim 11, wherein said at least one clamp is a pair of clamps, each clamp of said pair of clamps being independently and slidably movable along said extent of said neck strap member.

18. The holder and stabilization system as in claim 11, wherein said neck strap member and said belt member are length adjustable, respectively, so as to fit users of different body sizes.

19. The holder and stabilization system as in claim 11, wherein said housing is a pouch and said plurality of side walls of said housing are constructed of a flexible material.

20. The holder and stabilization system as in claim 19, wherein said housing includes a zippered pouch extending along a side wall of said housing and defining an interior space, said zippered pouching being operable for opening or closing for selectively allowing or preventing access to said interior space, respectively.

* * * * *